US007442484B2

(12) United States Patent
Uchinokura et al.

(10) Patent No.: US 7,442,484 B2
(45) Date of Patent: Oct. 28, 2008

(54) IMAGE FORMING METHOD USING TONER

(75) Inventors: Osamu Uchinokura, Numazu (JP); Akihiro Kotsugai, Numazu (JP); Yasuo Asahina, Numazu (JP); Tomoyuki Ichikawa, Kawasaki (JP); Shinya Nakayama, Numazu (JP); Kohichi Sakata, Numazu (JP); Tomoko Utsumi, Ebina (JP); Hisashi Nakajima, Numazu (JP); Yasuaki Iwamoto, Numazu (JP); Hideki Sugiura, Fuji (JP); Satoshi Mochizuki, Numazu (JP)

(73) Assignee: Ricoh Company Limited, Tokyo (JP)

( * ) Notice: Subject to any disclaimer, the term of this patent is extended or adjusted under 35 U.S.C. 154(b) by 202 days.

(21) Appl. No.: 10/969,076

(22) Filed: Oct. 21, 2004

(65) Prior Publication Data

US 2005/0089787 A1 Apr. 28, 2005

(30) Foreign Application Priority Data

Oct. 22, 2003 (JP) ..... 2003-361851

(51) Int. Cl.
*G03G 15/20* (2006.01)

(52) U.S. Cl. ..... 430/124.31; 430/124.1; 430/109.4

(58) Field of Classification Search ..... 430/124, 430/109.4, 110.4, 124.31, 124.1, 111.4; 399/330
See application file for complete search history.

(56) References Cited

U.S. PATENT DOCUMENTS 6,449,457 B2 9/2002 Samei et al.
6,497,983 B2 12/2002 Iwa et al.
6,660,443 B2 12/2003 Sugiyama et al.
7,129,013 B2 * 10/2006 Higuchi et al. ..... 430/108.4
2001/0018002 A1 8/2001 Samei et al.
2002/0031381 A1 * 3/2002 Miyahara et al. ..... 399/330
2002/0037466 A1 3/2002 Kanbayashi et al.
2003/0022084 A1 * 1/2003 Sugiyama et al. ..... 430/108.1

(Continued)

FOREIGN PATENT DOCUMENTS

CN 1300965 A 6/2001

(Continued)

OTHER PUBLICATIONS

U.S. Appl. No. 11/738,149, filed Apr. 20, 2007, Iwamoto et al.

(Continued)

*Primary Examiner*—John L Goodrow
(74) *Attorney, Agent, or Firm*—Oblon, Spivak, McClelland, Maier & Neustadt, P.C.

(57) ABSTRACT

An image forming method including: forming a toner image on a support using a toner including toner particles; and feeding the support bearing the toner image thereon through a nip between an endless toner heating member and a pressure roller to fix the toner image on the support, wherein the endless toner heating member is rotated while stretched by a fixing roller and a heat roller which includes a magnetic metal and which is heated by electromagnetic induction, and wherein the pressure roller presses the support to the endless toner heating member and the fixing roller at the nip, wherein the toner particles are prepared by a polymerizing method using a binder resin containing at least a modified polyester resin.

13 Claims, 3 Drawing Sheets

U.S. PATENT DOCUMENTS

| | | | | |
|---|---|---|---|---|
| 2003/0138717 | A1* | 7/2003 | Yagi et al. | 430/110.4 |
| 2003/0156866 | A1* | 8/2003 | Shida et al. | 399/328 |
| 2004/0115551 | A1 | 6/2004 | Sugiyama et al. | |
| 2004/0121256 | A1 | 6/2004 | Suzuki et al. | |
| 2004/0131961 | A1 | 7/2004 | Watanabe et al. | |
| 2004/0142265 | A1 | 7/2004 | Tomita et al. | |
| 2004/0146795 | A1 | 7/2004 | Emoto et al. | |

FOREIGN PATENT DOCUMENTS

| | | | |
|---|---|---|---|
| CN | 1349135 | A | 5/2002 |
| CN | 1416025 | A | 5/2003 |
| EP | 1 347 343 | A1 | 9/2003 |
| JP | 63-313182 | | 12/1988 |
| JP | 1-263679 | | 10/1989 |
| JP | 8-22206 | | 1/1996 |
| JP | 11-084716 | | 3/1999 |
| JP | 2000-292973 | | 10/2000 |
| JP | 2000-292978 | | 10/2000 |
| JP | 2003-140395 | | 5/2003 |

OTHER PUBLICATIONS

U.S. Appl. No. 11/755,484, filed May 30, 2007, Watanabe et al.
U.S. Appl. No. 11/755,517, filed May 30, 2007, Iwamoto et al.
U.S. Appl. No. 11/558,736, filed Nov. 10, 2006, Osamu Uchinokura et al.
U.S. Appl. No. 11/934,929, filed Nov. 21, 2007, Nakayama et al.
U.S. Appl. No. 11/950,114, filed Dec. 4, 2007, Shitara et al.
U.S. Appl. No. 11/338,700, filed Jan. 25, 2006, Kotsugai et al.
U.S. Appl. No. 11/685,872, filed Mar. 14, 2007, Uchinokura et al.
U.S. Appl. No. 11/685,969, filed Mar. 14, 2007, Uchinokura et al.
U.S. Appl. No. 11/181,844, filed Jul. 15, 2005, Sugiura.
U.S. Appl. No. 11/185,803, filed Jul. 21, 2005, Sugiura et al.
U.S. Appl. No. 11/227,178, filed Sep. 16, 2005, Hasegawa et al.
U.S. Appl. No. 10/724,260, filed Dec. 1, 2003, Yagi et al.
U.S. Appl. No. 10/729,960, filed Dec. 9, 2003, Tomita et al.
U.S. Appl. No. 10/724,150, filed Dec. 1, 2003, Tomita et al.
U.S. Appl. No. 10/645,804, filed Aug. 22, 2003, Tomita et al.
U.S. Appl. No. 11/868,618, filed Oct. 8, 2007, Sugiyama et al.
U.S. Appl. No. 11/519,057, filed Sep. 12, 2006, Nakayama et al.
U.S. Appl. No. 11/234,415, filed Sep. 26, 2005, Nakayama et al.
U.S. Appl. No. 11/227,566, filed Sep. 16, 2005, Nagatomo et al.
U.S. Appl. No. 12/040,451, filed Feb. 29, 2008, Saitoh et al.
U.S. Appl. No. 12/048,823, filed Mar. 14, 2008, Honda et al.
U.S. Appl. No. 12/042,041, filed Mar. 4, 2008, Yamada et al.
U.S. Appl. No. 12/050,502, filed Mar. 18, 2008, Yamada et al.
U.S. Appl. No. 12/046,011, filed Mar. 11, 2008, Nagatomo et al.
U.S. Appl. No. 12/042,807, filed Mar. 13, 2008, Honda et al.

* cited by examiner

IMAGE FORMING METHOD USING TONER

BACKGROUND OF THE INVENTION

1. Field of the Invention

The present invention relates to an image forming method for use in producing toner images in image forming apparatus such as printers, copiers and facsimile machines. More particularly, the present invention relates to an image forming method using an electromagnetic induction toner fixing method.

2. Discussion of the Background

Image forming apparatus, which produce toner images using an image forming method such as electrophotography, electrostatic recording and magnetic recording, have been widely used as printers, copiers and facsimile machines. The image forming apparatus typically perform the following image forming operations:

(1) a toner image is formed on a receiving material such as plain papers, photosensitive materials and electrostatic recording materials, using a direct or indirect image transfer method; and (2) the toner image is fixed on the receiving material by a heat fixing method such as heat roller fixing methods, film fixing methods and electromagnetic induction toner fixing method.

Recently, there are various needs (such as energy saving and high speed image formation) for the image forming apparatus. In order to fulfill the needs, it is important to improve the heat efficiency of the fixing device used for the image forming apparatus.

Heat roller fixing devices typically include a fixing roller which includes a heat source such as halogen lamps therein and which is heated by the heat source while the temperature thereof is controlled so as to be a predetermined temperature, and a pressure roller which is rotated while contacting the heat roller. A receiving material bearing an unfixed toner image thereon is fed through the nip between the pair of heat roller and pressure roller so that the toner image is melted and fixed thereon by the heat and pressure applied by the pair of rollers.

Heat fixing devices using a film have been disclosed in published unexamined Japanese patent applications Nos. (hereinafter referred to as JP-As) 63-313182 and 01-263679. In such heat fixing devices, a receiving material bearing a toner image thereon is heated by being contacted with a thin heat resistant film which is rotated while contacted with a heating member supported by a support, so that the toner image is fixed on the receiving material. Suitable heaters for use as the heating member include ceramic heaters having a constitution such that a resistive element is provided on a ceramic substrate such as alumina and aluminum nitride which has good heat resistance, good insulating property and good heat conductivity. Since the film is thin and has low heat capacity, the film heat fixing devices have advantages over the heat roller fixing devices such that the fixing devices have a relatively high heat transfer efficiency and short warm-up time and thereby image forming operations can be quickly started, resulting in energy saving.

JP-A 08-22206 discloses an electromagnetic induction heat fixing technique in that an alternate magnetic field is applied to a heating member including a magnetic metallic member to generate eddy current therein, resulting in generation of Joule heat therein.

A conventional electromagnetic induction heat fixing device will be explained referring to a drawing.

FIG. 3 is a schematic view illustrating a conventional electromagnetic induction heat fixing device. The heat fixing device includes a film guide 21 containing a heating member 20 having an excitation coil unit 18 and a magnetic metallic member 19 serving as a heater; a heat resistant cylindrical film 17 which rotates while the inner surface thereof is contacted with the outer surface of the film guide 21 at a position of the magnetic metallic member 19; and a pressure roller 22 which is contacted with the film 17 while forming a nip N therebetween and which rotates the film 17.

Suitable films for use as the film 17 include heat resistant films having a thickness not greater than 100 μm, and preferably from 20 to 50 μm. Specific examples thereof include films made of a polytetrafluoroethylene (PTFE), a perfluoroethylene/perfluoroalkoxyethylene copolymer (PFA), or a fluoroethylene/propylene copolymer (FEP); and complex films in which a resin such as PTFE, PFA or FEP is coated on a peripheral surface of a film such as polyimides, polyamide-imide, polyether ether ketone (PEEK), polyether sulfone (PES) and polyphenylene sulfide (PPS).

The film guide 21 is formed of a resin material having a high heat resistance and a high stiffness, such as PEEK and PPS. The heating member 20 is set in substantially the center portion of the film guide 20 and extends in the longitudinal direction of the film guide 20.

The pressure roller 22 includes a core 22*a* and a heat resistant rubber layer 22*b* which is made of a rubber with good releasability such as silicone rubbers and which is formed on the core 22*a*. The pressure roller 22 is pressed by a pressing member or a bearing (both are not shown) such that the film 17 is pressed to the magnetic metallic member 19 of the heating member 20. The pressure roller 22 is rotated counterclockwise by a driving device (not shown).

When the pressure roller 22 is rotated, the film 17 is also rotated due to friction between the film 17 and the pressure roller 22. Thus, the film 17 is rotated while contacting the heating member 20.

When the heating member 20 is heated to a predetermined temperature, a receiving material 11 bearing an unfixed toner image T thereon which is formed by an image forming section (not shown) is fed into the nip N between the film 17 and the pressure roller 22. The heat generated by the magnetic metallic member 19 of the heating member 20 is applied to the receiving material 11 via the film 17, and thereby the toner image T is melted and fixed on the receiving material 11. Then the receiving material 11 is separated from the surface of the film 17 at the exit of the nip N, and is fed to a discharge tray (not shown).

In the electromagnetic induction heat fixing device, the magnetic metallic member 19 can be set at a position closer to the toner image on the receiving material than in the case of the above-mentioned heating device using a film because heat generated by eddy current is used for the electromagnetic induction heat fixing device. Therefore, the electromagnetic induction heat fixing device has better heat efficiency than the heating device using a film.

When full color images are fixed by a fixing device, the fixing device has to have an ability to sufficiently melt four or more color toner layers, which are overlaid on a receiving material, to fix the color toner layers on the receiving material. In order to fulfill the requirement, the electromagnetic induction heat fixing device typically uses a film having an elastic layer with a certain thickness thereon, to heat and melt the toner layers while enveloping the toner layers. When a silicone rubber is formed on the surface of the film as the elastic layer, the heat response of the film deteriorates because the elastic layer has poor heat conductivity. When a large amount of toner images are fixed by such a fixing device, the temperature of the outer surface of the film rapidly falls, and thereby a fixing problem in that the toner images are insufficiently fixed and/or a cold offset problem in that the toner images adhere to the film and then re-transferred to an undesired position of the receiving sheet or another receiving sheet occur.

In image forming methods using a toner, electrostatic or magnetic latent images are developed with the toner. For example, in electrophotography, an electrostatic latent image, which is formed on a photoreceptor, is developed with a toner, resulting in formation of a toner image on the photoreceptor. The toner image is typically transferred to a receiving material such as papers, and then fixed thereon upon application of heat thereto.

The toner used for developing electrostatic latent images typically includes colored particles in which a colorant, a charge controlling agent and additives are dispersed in a binder resin. The methods for producing toners are broadly classified into pulverization methods and suspension polymerization methods.

Pulverization methods typically include the following processes:

(1) toner constituents such as a thermoplastic resin (serving as a binder resin), a colorant, a charge controlling agent and additives such as an offset preventing agent are heated and kneaded to disperse the colorant, charge controlling agent and additives in the thermoplastic resin;

(2) the kneaded mixture is cooled and then pulverized;

(3) the pulverized mixture is classified, resulting in preparation of toner particles.

The toners prepared by the pulverization methods have fairly good characteristics, but only limited materials can be used as the toner constituents. Specifically, the kneaded mixture has to be easily pulverized by a general economic pulverizer and the resultant powder has to be classified by a general economic classifier. Namely, the kneaded mixture has to be brittle. Therefore, when the kneaded mixture is pulverized, the resultant powder has a wide particle diameter distribution. In order to produce toner images having good resolution, the toner particles preferably have a particle diameter of from about 5 μm to about 20 μm, and therefore fine particles having a particle diameter, for example, less than 5 μm and coarse particles having a particle diameter, for example, greater than 20 μm are preferably removed. Therefore, the yield of the toner is low. In addition, when the pulverization methods are used for producing a toner, it is difficult to uniformly disperse materials such as colorants and charge controlling agents in a binder resin. In this case, the resultant toner has poor fluidity, developability and durability and therefore the resultant toner images have poor image qualities.

In attempting to solve such problems, toner manufacturing methods using suspension polymerization techniques have been proposed and are practically used now. However, the resultant toners typically have a spherical form, and have poor cleanability. When images with a low image area proportion are developed using such toners, no problem occurs. However, when images (such as pictorial images) with a high image area proportion are developed, or when a receiving paper is jammed while the toner image is not transferred to a receiving paper, a large amount of toner particles remain on the photoreceptor used. Since the residual toner particles cannot be well removed from the surface of the photoreceptor, and thereby the resultant toner images have undesired background development. In addition, since the contact area of toner particles decreases due to spherical form of the toner particles, and thereby the adhesion of the toner particles to receiving materials decreases, resulting in deterioration of fixing flexibility of the toner. Specifically, the resultant toner has unstable low temperature fixability.

In attempting to solve the problem, a method in which a particulate resin prepared by an emulsion polymerization method is aggregated to prepare toner particles having irregular forms is proposed in Japanese Patent No. 2,537,503 (i.e., JP-A 63-186253). However, the thus prepared toner particles include a large amount of surfactant on the surface thereof and therein, and therefore the toner has poor charge stability when environmental conditions (such as humidity) change. In addition, the toner has a wide charge quantity distribution, and thereby the background development problem in which background of images is soiled with toner particles is caused. Further, the image forming devices such as photoreceptors, chargers, and developing rollers are contaminated by the surfactant included in the toner, and thereby problems such that the abilities of the devices cannot be well exhibited occur.

In the fixing process, toner is required to have a good releasability (hereinafter referred to as offset resistance) against the heating members. In order to enhance the releasability of a toner, it is important that a release agent is present on the surface of the toner. Specifically, JP-As 2000-292973 and 2000-292978 have disclosed a technique in that a particulate resin is included in the toner particles such that the concentration of the particulate resin is higher in the surface portion of the toner particles than that in the other portions of the toner particles. However, the lowest fixable temperature of the toner is relatively high, namely the toner has poor low temperature fixability and poor energy saving property.

The toner prepared by the method, in which a particulate resin prepared by an emulsion polymerization method is aggregated to prepare toner particles having irregular form, has the following drawbacks:

(1) when the particulate resin is aggregated together with a particulate releasing agent and a colorant, the releasing agent tends to be included in the particulate resin, and thereby good releasability cannot be imparted to the resultant toner;

(2) since toner particles are prepared while the particles of the particulate resin, particulate releasing agent and colorant are randomly fused to the other particles, the formula of the resultant toner particles and the molecular weight of the binder resin included in the toner particles vary, and thereby the surface properties of the toner particles vary. Therefore, it is impossible for the toner to produce high quality images for a long period of time. In addition, when the toner is used for low temperature fixing devices, the cold offset problem tends to occur because the particulate resin present on the surface of the toner particles deteriorates the low temperature fixability of the toner.

Further, when the toner is used for fixing devices using a film on which an elastic layer having low heat conductivity is formed, a smear problem in that when the fixed toner image is rubbed, the toner image is damaged (the toner image is broken at the intermediate portion thereof) and thereby the background area is smeared is caused. This is because the fixing device has poor heat response as mentioned above and therefore the toner particles in the toner image are insufficiently fused with each other although the toner particles in the upper portion of the toner image are fused to the adjacent toner particles and the adhesion of the toner particles in the bottom portion of the toner image to the receiving material is acceptable due to heat and pressure of the pressure roller.

Because of these reasons, a need exists for an image forming method by which high quality images can be produced for a long period of time without causing the offset problem, low temperature fixing problem and smear problem.

SUMMARY OF THE INVENTION

Accordingly, an object of the present invention is to provide an image forming method by which high quality images can be produced for a long period of time without causing the offset problem, low temperature fixing problem and smear problem.

This object and other objects of the present invention, either individually or collectively, have been satisfied by the discovery of an image forming method comprising:

forming a toner image on a support (i.e., a receiving material) using a toner comprising toner particles which are prepared by a method comprising:

dissolving or dispersing toner constituents comprising a binder resin including at least a modified polyester resin capable of reacting with a compound having an active hydrogen atom in an organic solvent to prepare a toner constituent liquid;

dispersing the toner constituent liquid in an aqueous medium comprising a particulate resin to prepare an emulsion;

reacting the modified polyester resin with a compound having an active hydrogen atom in the emulsion to crosslink and/or extend the modified polyester resin; and removing the organic solvent from the emulsion, and feeding the support bearing the toner image thereon through a nip between an endless toner heating member and a pressure roller to fix the toner image on the support, wherein the endless toner heating member is rotated while stretched by a fixing roller and a heat roller which comprises a magnetic metal and which is heated by electromagnetic induction, and wherein the pressure roller presses the support bearing the toner image to the endless toner heating member and the fixing roller at the nip.

The endless toner heating member preferably has a thickness of from 50 to 500 μm.

It is preferable that the binder resin further includes an unmodified polyester resin in an amount such that the ratio (i)/(ii) of the modified polyester resin (i) to the unmodified polyester resin is from 5/95 to 75/25.

The binder resin preferably has an acid value of from 0.5 to 40 mgKOH/g, and a glass transition temperature (Tg) of from 40 to 70° C., and more preferably from 40 to 55° C.

The particulate resin is preferably selected from the group consisting of vinyl resins, polyurethane resins, polyester resins, and mixtures thereof. The particulate resin preferably has an average particle diameter of from 5 to 500 nm.

The toner preferably has a storage modulus G' of from 700 Pa to 7000 Pa at 180° C. under a condition of 1 Hz in frequency.

The toner preferably has a volume average particle diameter (Dv) of from 4 to 8 μm, and a ratio (Dv/Dn) of the volume average particle diameter (Dv) to a number average particle diameter (Dn) not greater than 1.25.

The toner preferably has an average circularity of from 0.90 to 0.96.

In the aging step, the emulsion is subjected to at least one of agitation and heating.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The image forming method of the present invention will be explained referring to drawings.

Figure 1A:
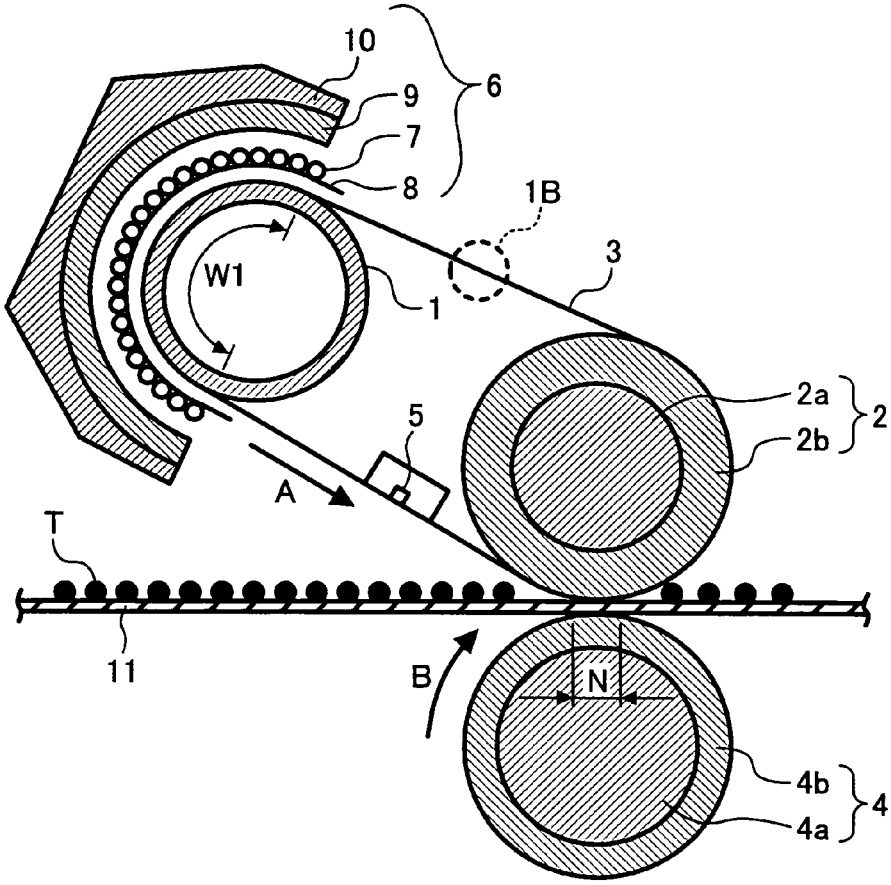
FIGS. 1A and 1B are schematic views illustrating an embodiment of the fixing device for use in the image forming method of the present invention.

FIG. 1A illustrates an embodiment of the fixing device for use in the image forming method of the present invention. In FIG. 1, the fixing device includes a heat roller 1 which is heated by the heat caused by electromagnetic induction of an induction heating member 6; a fixing roller 2 which is arranged so as to be parallel to the heat roller 1; and a heat resistant belt 3 (serving as a toner heating medium) which is rotated in a direction indicated by an arrow A while stretched by the heat roller 1 and the fixing roller 2 and which is heated by the heat roller 1; a pressure roller 4 which presses a receiving material 11 bearing a toner image T thereon to the belt 3 and the fixing roller 2 and which is rotated in a direction indicated by an arrow B.

The heat roller 1 includes a metal cylinder made of a metal such as iron, cobalt, nickel and alloys thereof. The outside diameter and thickness of the metal cylinder are 20 mm and 0.1 mm in this embodiment. Therefore, the heat roller 1 has a low heat capacity and thereby the temperature of the heat roller 1 can be rapidly raised. Therefore, warm-up time can be shortened.

The fixing roller 2 includes a core 2*a* made of a metal such as stainless steel and an elastic layer 2*b* which is located on the core 2*a* and which is made of a solid or foamed silicone rubber having high heat resistance. The diameter of the fixing roller 2 is about 40 mm which is larger than that of the heat roller 1 so that a nip N having a certain width is formed between the pressure roller 4 and the fixing roller 2 by the pressure of the pressure roller 4. The elastic layer 2*b* has a thickness of from 3 to 6 mm and an Asker hardness of from about 40° to about 60°.

The belt 3 which is stretched by the heat roller 1 and the fixing roller 2 is heated by the heat roller 1, which is heated by the induction heating member 6, at a contact portion W1. Since the belt 3 is rotated by the heat roller 1 and the fixing roller 2, the belt 3 is continuously heated, and thereby entire the belt 3 is heated.

Figure 1B:
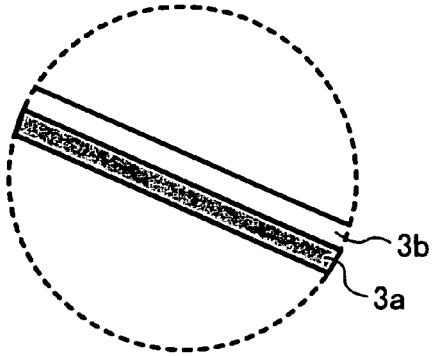

As illustrated in FIG. 1B, the belt 3 has a heat generation layer 3*a* and a release layer 3*b*. The thickness of the release layer 3*b* is preferably from 50 to 500 μm, and more preferably about 200 μm. When the belt 3 has such a constitution, the toner image T can be enveloped by the surface portion of the belt 3, and thereby the toner image T can be uniformly heated and melted.

When the release layer 3*b* is too thin, the belt 3 has too small heat capacity, and thereby the temperature of surface of the belt 3 rapidly decreases when the belt contacts a receiving material 11 to fix the toner image T on the receiving material 11. Therefore, the toner image cannot be well fixed to the receiving material 11. In contrast, when the release layer 3*b* is too thick, the belt has too large heat capacity, and thereby the warm-up of the fixing device is prolonged. In addition, the temperature of surface of the belt 3 is maintained even at the exit of the fixing portion, and thereby the melted toner image is not cohered. Therefore, a hot offset problem in that the toner image T adheres to the belt 3 tends to occur.

The heat generation layer 3*a* is typically made of a metal such as iron, cobalt, nickel and alloys thereof. However, the heat generation layer 3*a* can be replaced with a layer of a resin such as fluorine-containing resins, polyimide resins, polyamide resins, polyamideimide resins, PEEK resins, PES resins and PPS resins.

The pressure roller 4 has a core 4*a* made of a metal having large heat conductivity such as copper and aluminum; and an elastic layer 4*b* which is located on the core 4*a* and which has a high heat resistance and a good toner releasability. The core 4*a* can be made of a stainless steel.

The pressure roller 4 is pressed to the fixing roller 2 with the belt 3 therebetween to form the nip N between the pressure roller 4 and the fixing roller 2 (i.e., the belt 3). In this embodiment, the pressure roller 4 is harder than the fixing roller 2, and thereby the fixing roller 2 (and the belt 3) is caved. Therefore, the receiving material 11 is fed along the peripheral surface of the pressure roller 4, and thereby the receiving material 11 can be easily released from the surface of the belt 3. The outside diameter of the pressure roller 4 is about 40 mm, which is almost the same as that of the fixing roller 2. However, the thickness of the elastic layer 4*b* is from about 1 to 3 mm, which is smaller than that of the elastic layer 2*b* of the fixing roller 2. In addition, the elastic layer 4*b* has an Asker hardness of from 50° to 70°, which is larger than that of the elastic layer 2*b*.

Figure 2A:
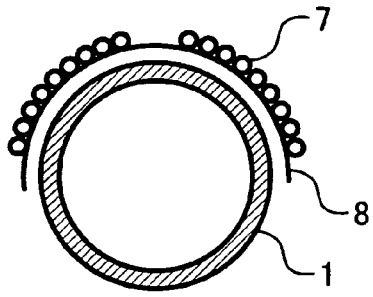
FIGS. 2A and 2B are a cross sectional view and a front view of the excitation coil which is used for the induction heating member of the fixing device illustrated in FIG. 1.
Figure 2B:
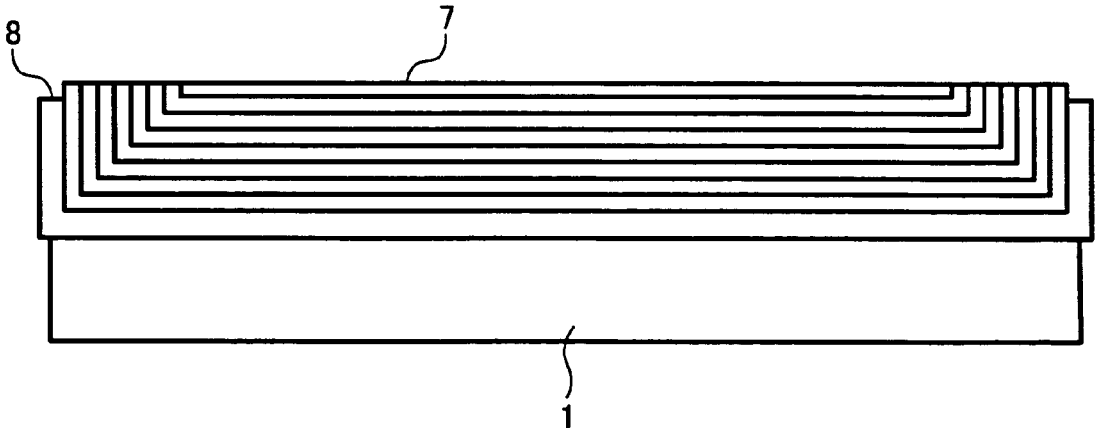

As illustrated in FIGS. 1, 2A and 2B, the induction heating member 6 which heats the heat roller 1 utilizing electromagnetic induction heating has an excitation coil 7 serving as magnetic field generating means and a guide plate 8 around which the excitation coil 7 is wound. The guide plate 8 has a shape like a half pipe and is arranged in close vicinity to the peripheral surface of the heat roller 1. As illustrated in FIG. 2B, the excitation coil 7, which is constituted of a long wire, is set on the peripheral surface of the guide plate 8 while advancing and retreating in the longitudinal direction of the guide plate 8.

The excitation coil 7 is connected with a power source (not shown) having a frequency-variable oscillating circuit.

Referring to FIG. 1, an excitation coil core 9 which has a shape like a half pipe and which is made of a ferromagnetic material such as ferrites is arranged in close vicinity to the excitation coil 7 while supported by a support 10. In this embodiment, the excitation coil core 9 has a specific magnetic permeability of 2500.

The power source applies a high frequency alternate current having a frequency of from 10 kHz to 1 MHz, and preferably from 20 kHz to 800 kHz, to the excitation coil to generate alternate magnetic field. The thus formed alternate magnetic field acts on the heat roller 1 and the heat generation layer 3*a* of the belt 3 at the contact portion W1 of the heat roller 1 with the belt 3 and the vicinity thereof, and thereby an eddy current I is flown in the heat roller 1 and the heat generation layer 3*a* so as to prevent change of the alternate magnetic field, resulting in generation of Joule heat, the amount of which depends on the resistance of the heat roller 1 and the heat generation layer 3*a*. Thus, the heat roller 1 and the belt 3 are heated by electromagnetic induction heating at the contact portion W1 and the vicinity thereof.

As illustrated in FIG. 1A, the temperature of the inner surface of the thus heated belt 3 is detected by a temperature detector 5 which includes a temperature sensor having a high heat response such as thermistors and which is set in the vicinity of the entrance of the nip N.

Then the toner for use in the image forming method of the present invention will be explained.

Degree of Crosslinking Reaction and/or Extension Reaction

The toner for use in the image forming method of the present invention includes toner particles prepared by the following method.

(1) toner constituents including at least a modified polyester resin capable of reacting an active hydrogen atom are dissolved or dispersed in an organic solvent to prepare a toner constituent liquid;

(2) the toner constituent liquid is dispersed in an aqueous medium including a particulate resin to prepare an emulsion while reacting the modified polyester resin with a compound having an active hydrogen atom (i.e., a crosslinking agent and/or an extending agent) to crosslink and/or extend the modified polyester resin;

(3) the dispersion is aged while agitated and heated, if desired, to complete the crosslinking reaction and/or the extension reaction; and (4) then the organic solvent is removed, resulting in formation of a dispersion including the toner particles.

The toner including the thus prepared toner particles has good negative charging property, good low temperature fixability and good hot offset resistance so as to be used for the image forming method including the fixing device mentioned above. In this case, the amount of the compound having an active hydrogen atom (i.e., the crosslinking agent and/or extending agent, hereinafter sometimes referred to as a reaction agent) remaining on the toner particles is preferably as small as possible to impart good charging property to the resultant toner particles.

When the amount of the reaction agent is large (i.e., the crosslinking reaction and/or the extension reaction is insufficiently performed), the reaction agent cannot be well removed even when a washing treatment is performed after the reaction. This is because the particulate resin which is added in the dispersion to control the particle diameter of the toner particles is adhered to the surface of the toner particles, thereby preventing the reaction agent from being removed from the surface of the toner particles.

Particularly, in a case where a polyester prepolymer having an isocyanate group is used as the modified polyester resin and an amine is used as the reaction agent, the resultant toner particles have unstable negative charge property if the amount of the amine remaining in the toner particles is large. This is because the amine and the polyester prepolymer impart positive charge property to the toner particles. Therefore, it is important to sufficiently crosslink and/or extend the polyester prepolymer with the amine to impart good negative charging property to the toner particles as well as good low temperature fixability and offset resistance.

Average Circularity and Circularity Distribution of Toner

The toner of the present invention preferably has an average circularity of from 0.90 to 0.96 to produce high definition images with proper image density. More preferably, the average circularity is from 0.940 to 0.955, and in addition the particles having a circularity less than 0.94 are included in the toner in an amount not greater than 15%.

When the average circularity is too large, a cleaning problem in that particles of the toner remaining on the surface of the photoreceptor and the intermediate transfer medium cannot be well removed with a cleaning blade occurs. This results in formation of background development in the resultant toner images particularly when images with a high image area proportion are produced. In addition, when particles of the toner remaining on the photoreceptor adhere to the charging roller, the charging ability of the charging roller deteriorates. In contrast, when the average circularity of the toner is too small, the toner has poor transferability and thereby high quality images with high sharpness (i.e., without toner scattering) cannot be produced.

In the present application, the circularity of a toner is determined by the following method using a flow-type particle image analyzer A-2100 from Sysmex Corp.

(1) a suspension including toner particles to be measured is passed through a detection area formed on a plate in the measuring instrument; and (2) the particles are optically detected by a CCD camera and then the shapes of the images of the particles are analyzed with an image analyzer.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The specific method for determining the average circularity of the toner is mentioned later.

Volume Average Particle Diameter (Dv) and Ratio (Dv/Dn) of Volume Average Particle Diameter (Dv) to Number Average Particle Diameter (Dn)

The toner of the present invention preferably has a volume average particle diameter (Dv) of from 4 to 8 μm, and a ratio (Dv/Dn) of the volume average particle diameter (Dv) to the number average particle diameter (Dn) not greater than 1.25 and more preferably from 1.10 to 1.25.

When the toner for use in the image forming method of the present invention has such a particle diameter (Dv) and a ratio (Dv/Dn) as mentioned above, the toner has good high temperature preservability, good low temperature fixability and good hot offset resistance. Particularly, when the toner is used for full color image forming apparatus, the resultant toner images have high glossiness. In addition, when the toner is used for a two component developer, the particle diameter distribution of the toner hardly changes and the developer can maintain good developability even when the developer is used for a long time while the toner is replenished and the developer is agitated in a developing device. Therefore images having good image qualities can be produced.

When the toner is used as a one component developer, the developer has the following advantages.

(1) even when the developer is used for a long time while the developer (toner) is replenished, the particle diameter distribution of the developer hardly changes; and (2) even when the developer is used for a long time while agitated in a developing device, the developer can maintain good developability and does not cause a problem in that the developer is adhered and fixed to the developing members such as developing rollers and developer layer forming blades.

Therefore images having good image qualities can be produced.

In general, the smaller the particle diameter of a toner, the better the resolution of the toner images, but the worse the transferability and cleanability of the toner. When the toner for use in the present invention has too small volume average particle diameter, the toner tends to be fixed to the surface of the carrier, which is used in combination with the toner to constitute a two component developer, and thereby the charging ability of the carrier deteriorates. When such a toner is used as a one component developer, the toner tends to cause a problem in that the developer is adhered and fixed to the developing members used such as a developing roller and a developer layer forming blade. The same is true for a case where the toner includes fine particles in an mount greater than that mentioned above.

In contrast, when the volume average particle diameter of the toner is too large, high resolution images cannot be produced and in addition a problem in that the particle diameter distribution of the toner changes when the toner is used while replenished occurs.

The same is true for a case where the ratio (Dv/Dn) is too large.

When the ratio (Dv/Dn) is too small, the toner cannot be well charged and the cleanability of the toner deteriorates although the resultant toner has advantages such that the behavior of the toner can be stabilized and the toner has uniform charge quantity.

Organic Solvent

Specific examples of the organic solvent for use in preparing the toner constituent liquid include organic solvents, which are preferably nonreactive with polyisocyates mentioned below, such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), ethers (e.g., tetrahydrofuran), etc.

Modified Polyester Resins

Suitable resins for use as the modified polyester resin (i) which can be reacted with a compound having an active hydrogen atom include polyester prepolymers having an isocyanate group. Polyester prepolymers having an isocyanate group can be prepared by reacting a polycondensation product of a polyol (1) and a polycarboxylic acid (2) (i.e., a polyester resin having a group including an active hydrogen atom), with a polyisocyanate (3). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable.

Suitable polyols (1) include diols (1-1), polyols (1-2) having three or more hydroxyl groups, and mixtures of DIO and TO. Preferably, diols (1-1) alone or mixtures of a small amount of a polyol (1-2) with a diol (1-1) are used.

Specific examples of the diols (DIO) include alkylene glycols, alkylene ether glycols, alicyclic diols, alkylene oxide adducts of alicyclic diols, bisphenols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the alkylene oxide adducts of alicyclic diols include adducts of the alicyclic diols mentioned above with an alkylene oxide (e.g., ethylene oxide, propylene oxide and butylene oxide). Specific examples of the bisphenols include bisphenol A, bisphenol F and bisphenol S. Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, and mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (2) include dicarboxylic acids (2-1) and polycarboxylic acids (2-2) having three or more carboxyl groups. Preferably, dicarboxylic acids (2-1) alone and mixtures of a small amount of a polycarboxylic acid (2-2) with a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

When the polycarboxylic acid (2) is reacted with a polyol (1), anhydrides or lower alkyl esters (e.g., methyl esters, ethyl esters or isopropyl esters) of the polycarboxylic acids mentioned above can also be used as the polycarboxylic acid (2).

Suitable mixing ratio (i.e., an equivalence ratio [OH]/[COOH]) of the [OH] of a polyol (1) to the [COOH] of a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., an equivalence ratio [NCO]/[OH]) of the [NCO] of a polyisocyanate (3) to the [OH] of a polyester is from 5/1 to 1/1, preferably from 4/1 to 1.2/1 and more preferably from 3/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester, which is crosslinked and/or extended, decreases, thereby deteriorating the hot offset resistance of the resultant toner.

Reaction Agent (Crosslinking Agent and Extending Agent)

Suitable compounds for use as the reaction agent include amines.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines, diamines (B1) and mixtures of a small amount of a polyamine (B2) with a diamine (B1) are preferably used.

The molecular weight of the urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., an equivalence ratio [NCO]/[NHx]) of the [NCO] of the prepolymer (A) having an isocyanate group to the [NHx] of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

Unmodified Polyester Resin

It is preferable to use a combination of a modified polyester resin (i) with an unmodified polyester resin (ii) as the binder resin of the toner for use in the present invention. By using such a combination, the low temperature fixability of the toner can be improved and in addition the toner can produce color images having a high glossiness.

Suitable materials for use as the unmodified polyester resins (ii) include polycondensation products of a polyol (1) with a polycarboxylic acid (2). Specific examples of the polyol (1) and polycarboxylic acid (2) are mentioned above for use in the modified polyester resins. In addition, specific examples of the suitable polyol and polycarboxylic acid are also mentioned above.

When a combination of a modified polyester resin with an unmodified polyester resin is used as the binder resin, it is preferable that the unmodified polyester resin is at least partially mixed with the modified polyester resin to improve the low temperature fixability and hot offset resistance of the resultant toner. Namely, it is preferable that the unmodified polyester resin has a molecular structure similar to that of the modified polyester resin.

The weight ratio of the modified polyester resin (i) to the unmodified polyester resin (ii) is from 5/95 to 75/25, preferably from 10/90 to 25/75, more preferably from 12/88 to 25/75, and even more preferably from 12/88 to 22/78. When the content of the modified polyester resin (i) is too low, the hot offset resistance of the toner deteriorates, and in addition good combination of high temperature preservability and low temperature fixability cannot be imparted to the resultant toner.

The unmodified polyester resin for use in the toner of the present invention preferably has a weight average molecular weight (Mw) of form 1,000 to 30,000, more preferably from 1,500 to 10,000, and even more preferably from 2,000 to 8,000 when the Mw is determined by a gel permeation chromatography. When the weight average molecular weight (Mw) is too low, the preservability of the toner deteriorates. In contrast, when the Mw is too high, the low temperature fixability of the toner deteriorates.

The unmodified polyester resin preferably has a hydroxyl value not less than 5 mgKOH/g, and more preferably from 10 to 120 mgKOH/g, and even more preferably from 20 to 80 mgKOH/g. When the hydroxyl value is too small, it is hard to impart good combination of preservability and low temperature fixability to the resultant toner.

The unmodified polyester resin preferably has an acid value of from 0.5 to 40 mgKOH/g, and more preferably from 5 to 35 mgKOH/g. When a resin having an acid value in this range is used as a binder resin, good negative charge property can be imparted to the toner.

When the acid value and/or the hydroxyl value of the unmodified polyester resin are greater than the ranges mentioned above, the charge properties of the resultant toner seriously change depending on environmental conditions (such as humidity). In particular, the toner tends to produce poor images under high temperature and high humidity conditions and low temperature and low humidity conditions.

The glass transition temperature (Tg) of the binder resin of the toner for use in the present invention is preferably from 40 to 70° C., and more preferably from 45 to 65° C. When the glass transition temperature is too low, the high temperature preservability of the toner deteriorates. In contrast, when the glass transition temperature is too high, the low temperature fixability of the toner deteriorates. The urea-modified polyester resins mentioned above for use in the toner tend to have better preservability than known polyester resins even when the urea-modified polyester resins have lower melting point than those of the known polyester resins.

Colorant

Known dyes and pigments can be used as the colorant of the toner of the present invention and one or more proper dyes and pigments are chosen and used for the toner.

Specific examples of the dyes and pigments include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), Permanent Red FRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner. When the content is too low or too high, a problem in that the image density decreases tends to occur.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent and water, if desired are removed from the mixture can be preferably used because the resultant wet cake can be used as it is without being dried. When performing the mixing and kneading process, dispersing devices capable of applying a high shearing force such as three roll mills can be preferably used.

Release Agent

The toner of the present invention can include a wax or the like as a release agent as well as the binder resin and colorant.

Known waxes can be used for the toner for use in the present invention. Specific examples of the waxes include polyolefin waxes such as polyethylene waxes and polypropylene waxes; hydrocarbons having a long chain such as paraffin waxes and SASOL waxes; waxes having a carbonyl group; etc.

Among these waxes, waxes having a carbonyl group are preferably used. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

The melting point of the waxes for use in the toner is generally from 40 to 160° C., preferably from 50 to 120° C., more preferably from 60 to 90° C. When the melting point of the wax used is too low, the preservability of the resultant toner deteriorates. In contrast, when the melting point is too high, the resultant toner tends to cause a cold offset problem in that a toner image adheres to a fixing roller when the toner image is fixed at a relatively low fixing temperature.

The waxes preferably have a melt viscosity of from 5 to 1000 mPa.s (i.e., 5 to 1000 cps), and more preferably from 10 to 100 mPa.s (i.e., 10 to 100 cps), at a temperature 20° C. higher than the melting point thereof. Waxes having too high a melt viscosity hardly produce hot offset resistance improving effect and low temperature fixability improving effect. In contrast, waxes having too low a melt viscosity deteriorates the releasability of the resultant toner.

The content of a wax in the toner of the present invention is generally from 0 to 40% by weight, and preferably from 3 to 30% by weight. When the content is too high, the fluidity of the toner deteriorates.

Charge Controlling Agent

The toner for use in the present invention can include a charge controlling agent if desired. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner for use in the present invention is changed depending on the variables such as choice of binder resin, presence of additives, and dispersion method. In general, the content the charge controlling agent is preferably from 0.1 to 10 parts by weight, and more preferably from 0.2 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

The charge controlling agent is kneaded together with a masterbatch, and the mixture is used for preparing toner particles. Alternatively, the charge controlling agent is dissolved or dispersed in an organic solvent together with other toner constituents. It is possible to adhere and fix a charge controlling agent to a surface of toner particles which are previously prepared.

Particulate Resin

When the toner constituent liquid is dispersed in an aqueous medium, the aqueous medium includes a particulate resin is included in the aqueous medium to control the particle diameter distribution of the resultant toner particles.

Suitable materials for use as the particulate resin include any known resins which can be dispersed in an aqueous medium. Specific examples of such resins include thermoplastic and thermosetting resins such as vinyl resins, polyurethane resins, epoxy resins, polyester resins, polyamide resins, polyimide resins, silicon-containing resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because aqueous dispersions of the resins can be easily prepared.

Specific examples of the vinyl resins include homopolymers and copolymers of vinyl monomers such as styrene—(meth)acrylate copolymers, styrene—butadiene copolymers, (meth)acrylic acid—acrylate copolymers, styrene—acrylonitrile copolymers, styrene—maleic anhydride copolymers, styrene—(meth)acrylic acid copolymers, etc.

The average particle diameter of the particulate resins is preferably from 5 to 500 nm, and more preferably from 30 to 120 nm. When the average particle diameter is too small, the particulate resins cannot be dispersed in the aqueous medium and become a paste (like rice cake). In contrast, when the average particle diameter is too large, the resultant toner particles have wide particle diameter distribution (i.e., the resultant toner particles do not have a sharp particle diameter distribution).

External Additive

The thus prepared toner particles are optionally mixed with an external additive to improve the fluidity and developability of the toner and to assist to improve the charge property of the toner. Inorganic fine particles are typically used as the external additive. Inorganic particulate materials having a primary particle diameter of from 5 nm to 2 μm and more preferably from 5 nm to 500 nm are typically used. The specific surface area of the inorganic particulate materials is preferably from 20 to 500 $m^2/g$ when measured by a BET method.

The content of the inorganic particulate material is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the external additive of the toner for use in the present invention.

The external additive used for the toner is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylating agents, silane coupling agents having a fluorinated alkyl group, organic titanate coupling agents, aluminum coupling agents, silicone oils, modified silicone oils, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods. When particulate resins are used as the cleanability improving agent, it is preferably for the particulate resins to have a relatively narrow particle diameter distribution and a volume average particle diameter of from 0.01 μm to 1 μm.

Toner Manufacturing Method

The modified polyester resin (i) which can be reacted with a compound having an active hydrogen atom and which is used for the binder resin of the toner for use in the present invention is prepared, for example, by the following method:

(1) at first, a polyol (1) and a polycarboxylic acid (2) are heated to a temperature of from 150 to 280° C. in the presence of an esterification catalyst such as tetrabutoxy titanate and dibutyltin oxide to be reacted while generated water is removed under a reduced pressure if necessary, resulting in preparation of a polyester resin having a hydroxyl group; and (2) the polyester resin is reacted with a polyisocyanate (3) at a temperature of from 40 to 140° C., resulting in preparation of a polyester prepolymer (A).

The thus prepared polyester prepolymer (A) is reacted with a reaction agent (i.e., a crosslinking agent and/or an extending agent) such as amines. When an amine is used as the reaction agent, the polyester prepolymer (A) is reacted with an amine (B) at a temperature of from 0 to 140° C., resulting in preparation of a urea-modified polyester resin.

The reaction of a polyester resin having a hydroxyl group with a polyisocyanate (3) and the reaction of a polyester prepolymer (A) with an amine can be performed in a solvent if desired. Specific examples of the solvent include solvents which are nonreactive with an isocyanate group, such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide); ethers (e.g., tetrahydrofuran); etc.

The unmodified polyester resin (ii) is prepared by a method similar to the method for preparing the polyester resin having a hydroxyl group. The unmodified polyester resin (ii) is used while mixed with the solution of the modified polyester resin (i).

The method for preparing the toner for use in the present invention is the following but is not limited thereto.

Toner Preparation Method in Aqueous Medium

Toner constituents such as a polyester prepolymer (A), an unmodified polyester resin, a colorant (or a colorant masterbatch), a release agent, and a charge controlling agent are dispersed or dissolved in an organic solvent to prepare a toner constituent liquid. The toner constituent liquid is dispersed in an aqueous medium including a particulate resin and is reacted with a reaction agent (i.e., a crosslinking agent and/or an extending agent, such as amines) so that the polyester prepolymer is crosslinked and/or extended, resulting in preparation of a modified polyester resin (such as urea-modified polyester resin). Thus, the toner particles are prepared in the aqueous medium.

Specific examples of the aqueous medium include water and water-soluble solvents such as alcohols (e.g., methanol, isopropanol and ethylene glycol), dimethylformamide, tetrahydrofuran, cellosolves (e.g., methylcellosolve), lower ketones (e.g., acetone and methyl ethyl ketone), etc.

The polyester prepolymer (A) is reacted with a reaction agent such as amines in an aqueous medium, to prepare a modified polyester resin which serves as the binder resin of the toner.

In order to stably disperse the polyester prepolymer (A) (toner constituents) in an aqueous medium, a method in which a shear force is applied to the polyester prepolymer (A) (i.e., toner constituents) is preferably used.

The toner constituents (e.g., colorants, colorant masterbatches, release agents, charge controlling agents, and unmodified polyester resins) other than the binder resin can be mixed when the toner constituent liquid is dispersed or dissolved in an organic solvent, but it is preferable that such toner constituents are also dissolved or dispersed in the toner constituent liquid and then the resultant toner constituent liquid is dispersed or dissolved in an organic solvent.

The toner constituents other than the binder resin, such as the colorant, release agent and charge controlling agent, are not necessarily added to an organic solvent when the toner constituent liquid is prepared, and can be added to the particles including the binder resin, which are prepared in an aqueous medium. For example, particles prepared in an aqueous medium can be dyed with a known dyeing method can be used.

The dispersing operation is not particularly limited, and known mixers and dispersing machines such as low shearing type dispersing machines, high shearing type dispersing machines, friction type dispersing machines, high pressure jet type dispersing machines and ultrasonic dispersing machine can be used.

In order to prepare the toner for use in the present invention, it is preferable to prepare an emulsion including particles having an average particle diameter of from 2 to 20 μm. Therefore, high shearing type dispersing machines are preferably used.

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C. The processing temperature is preferably as high as possible because the viscosity of the dispersion decreases and thereby the dispersing operation can be easily performed.

When the toner constituent liquid is dispersed in an aqueous medium, the weight ratio of the aqueous medium to the toner constituents is generally from 50/100 to 2000/100, and preferably from 100/100 to 1000/100. When the amount of the aqueous medium is too small, the toner constituents tend not to be well dispersed, and thereby a toner having a desired particle diameter cannot be prepared. In contrast, to use a large amount of aqueous medium is not economical.

A dispersant can be used for the dispersion process to prepare toner particles having a sharp particle diameter distribution and to prepare a stable emulsion.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

By using a fluorine-containing surfactant as the surfactant, good effects can be produced even when the added amount of the surfactant is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse the toner constituent liquid in an aqueous medium, include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, inorganic dispersants which are hardly soluble in water can also be used as the dispersant. Specific examples thereof include tricalcium phosphate, calcium carbonate, colloidal titanium oxide, colloidal silica, and hydroxyapatite.

Further, it is preferable to stabilize the emulsion using a polymer protection colloid.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protection colloid.

When a dispersant is used for dispersing the toner constituent mixture in an aqueous medium, the dispersant is preferably removed by washing the resultant toner particles after the crosslinking and/or extension reaction in order to impart good charge properties to the toner particles although it is possible that the dispersant is allowed to remain on the surface of the toner particles.

When a dispersant, which can be dissolved in an acid or an alkali, such as calcium phosphate, is used, it is preferable to dissolve the dispersant with hydrochloric acid to remove that from the toner particles, followed by washing. In addition, it is possible to remove such a dispersant by decomposing the dispersant using an enzyme.

When the toner constituents are dissolved or dispersed in an organic solvent, it is preferable that the solvent can dissolve the polyester prepolymer (A) and the modified polyester resin which is produced as a result of reaction of the polyester prepolymer with a reaction agent (i.e., a crosslinking agent and/or an extending agent) so that the resultant toner constituent liquid has a low viscosity and thereby the resultant toner particles have a sharp particle diameter distribution.

The organic solvent is preferably volatile solvents having a boiling point less than 100° C. so as to be easily removed from the emulsion including the particles which become toner particles when the organic solvent is removed therefrom. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the organic solvent to the polyester prepolymer (A) is generally from 0/100 to 300/100, preferably from 0/100 to 100/100 and more preferably from 25/100 to 70/100.

The organic solvent included in the emulsion is removed at a normal or reduced pressure after the crosslinking and/or extension reaction.

The reaction time is determined depending on the reactivity of the isocyanate group of the polyester prepolymer with the amine used, and is generally from 10 minutes to 40 hours, and preferably from 30 minutes to 12 hours. The reaction temperature is generally from 0 to 150° C., and preferably from 15 to 45° C.

In addition, known catalysts such as dibutyltin laurate and dioctyltin layrate can be used for the reaction, if desired.

In order to remove an organic solvent from the thus prepared emulsion, a method in which the emulsion is gradually heated to perfectly evaporate the organic solvent in the emulsion can be used. Alternatively, a method in which the emulsion is sprayed in a dry environment to dry the organic solvent in the drops of the toner constituent liquid and water in the emulsion, resulting in formation of toner particles, can be used. Specific examples of the dry environment include gases of air, nitrogen, carbon dioxide, combustion gas, etc., which are preferably heated to a temperature not lower than the boiling point of the solvent having the highest boiling point among the solvents included in the emulsion. Toner particles having desired properties can be rapidly prepared by performing this treatment using a spray dryer, a belt dryer, a rotary kiln, etc.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared dry toner particles can be mixed with one or more other particulate materials such as release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Carrier for Use in Two Component Developer

The thus prepared toner can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner prepared above can also be used as a one-component magnetic developer or a one-component non-magnetic developer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Particulate Resin Dispersion

In a reaction vessel equipped with a stirrer and a thermometer, 683 parts of water, 15 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid, hereinafter referred to as particulate resin dispersion (1)) was prepared.

The volume average particle diameter of the particles in the particulate resin dispersion (1), which was measured with an instrument LA-920 from Horiba Ltd., was 60 nm.

Preparation of Aqueous Phase Liquid

In a reaction vessel equipped with a stirrer, 990 parts of water, 37 parts of an aqueous solution of a sodium salt of dodecyldiphenyletherdisulfonic acid (ELEMINOL MON-7 from Sanyo Chemical Industries Ltd., solid content of 48.5%), and 90 parts of ethyl acetate were mixed while agitated. As a result, a milky liquid (hereinafter referred to as an aqueous phase liquid 1) was prepared.

Preparation of Unmodified Polyester Resin

The following components were contained in a reaction container equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg.

Further, 44 parts of trimellitic anhydride were fed to the container to be reacted with the reaction product for 2 hours at 180° C. Thus, an unmodified polyester resin 1 was prepared. The unmodified polyester resin 1 has a number average molecular weight of 2500, a weight average molecular weight of 6700, a glass transition temperature (Tg) of 43° C. and an acid value of 25 mgKOH/g.

Preparation of Intermediate Polyester and Polyester Prepolymer

The following components were contained in a reaction vessel equipped with a condenser, a stirrer and a nitrogen feed pipe and reacted for 8 hours at 230° C. under normal pressure.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

Then the reaction was further continued for 5 hours under a reduced pressure of from 10 to 15 mmHg. Thus, an intermediate polyester resin 1 was prepared. The intermediate polyester 1 has a number average molecular weight of 2100, a weight average molecular weight of 9500, a glass transition temperature (Tg) of 55° C., an acid value of 0.5 mgKOH/g and a hydroxyl value of 51 mgKOH/g.

In a reaction vessel equipped with a condenser, a stirrer and a nitrogen feed pipe, 410 parts of the intermediate polyester resin 1, 89 parts of isophorone diisocyanate and 500 parts of ethyl acetate were mixed and the mixture was heated at 100° C. for 2 hours to perform the reaction. Thus, a polyester prepolymer 1 having an isocyanate group was prepared. The content of free isocyanate included in the polyester prepolymer 1 was 1.53% by weight.

Synthesis of Ketimine Compound

In a reaction vessel equipped with a stirrer and a thermometer, 170 parts of isophorone diamine and 75 parts of methyl ethyl ketone were mixed and reacted for 5 hours at 50° C. to prepare a ketimine compound. The ketimine compound has an amine value of 418 mgKOH/g.

Preparation of Masterbatch

The following components were mixed using a HENSCHEL mixer from Mitsui Mining Co., Ltd.

| | |
|---|---|
| Water | 1200 parts |
| Carbon black (PRINTEX 35 from Degussa AG, having DBP absorption of 42 ml/100 mg, and pH of 9.5) | 800 parts |
| Polyester resin | 1200 parts |

The mixture was kneaded for 30 minutes at 150° C. using a two roll mill. Then the kneaded mixture was cooled by rolling, followed by pulverizing. Thus, a masterbatch 1 was prepared.

Preparation of Oil Phase Liquid

In a reaction vessel equipped with a stirrer and a thermometer, 378 parts of the unmodified polyester resin 1, 110 parts of carnauba wax, 22 parts of a charge controlling agent (salicylic acid metal complex E-84 from Orient Chemical Co., Ltd.), and 947 parts of ethyl acetate were mixed and the mixture was heated to 80° C. while agitated. After the mixture was heated at 80° C. for 5 hours, the mixture was cooled to 30° C. over 1 hour. Then 500 parts of the masterbatch 1 and 500 parts of ethyl acetate were added to the vessel, and the mixture was agitated for 1 hour to prepare a raw material dispersion 1.

Then 1324 parts of the raw material dispersion 1 were subjected to a dispersion treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of 65% ethyl acetate solution of the unmodified polyester resin 1 prepared above were added thereto. The mixture was subjected to the dispersion treatment using the bead mill. The dispersion conditions are the same as those mentioned above except that the dispersion operation was performed once (i.e., one pass).

The thus prepared colorant/wax dispersion (1) had a solid content of 50% when it was determined by heating the liquid at 130° C. for 30 minutes.

Then the following components were mixed in a vessel.

| | |
|---|---|
| Colorant/wax dispersion (1) prepared above | 749 parts |
| Prepolymer (1) prepared above | 115 parts |
| Ketimine compound (1) prepared above | 2.9 parts |

The components were mixed for 1 minute using a TK HOMOMIXER from Tokushu Kika Kogyo K. K. at a revolution of 5000 rpm. Thus, an oil phase liquid (1) was prepared.

Emulsification, Aging and Solvent Removal

In a container, 1200 parts of the aqueous phase liquid 1 and 866.9 parts of the oil phase liquid 1 prepared above were mixed and the mixture was mixed for 20 minutes using TK HOMOMIXER at a revolution of 13000 rpm. Thus, an emulsion 1 was prepared.

The emulsion 1 was fed into a container equipped with a stirrer having paddles and a thermometer, and the emulsion was aged for 90 minutes at 28° C. while agitated by the stirrer at a revolution of 200 rpm. Then the emulsion was heated for 8 hours at 30° C. to remove the organic solvent (ethyl acetate) from the emulsion. Thus, a dispersion 1 was prepared. The particles dispersed in the dispersion 1 have a volume average particle diameter of 6.01 μm and a number average particle diameter of 5.75 μm, which was measured with an instrument MULTISIZER II from Coulter Electronics, Inc.

Washing and Drying

One hundred parts of the dispersion 1 were filtered under a reduced pressure.

Then the wet cake was mixed with 100 parts of ion-exchange water and the mixture was agitated for 10 minutes with a TK HOMOMIXER at a revolution of 12,000 rpm, followed by filtering. Thus, a wet cake (a) was prepared.

The thus prepared wet cake (a) was mixed with 100 parts of a 10% hydrochloric acid and the mixture was agitated for 10 minutes with TK HQMOMIXER at a revolution of 12,000 rpm, followed by filtering. Thus, a wet cake (b) was prepared.

Then the wet cake (b) was mixed with 300 parts of ion-exchange water with a temperature of 25° C. and the mixture was agitated for 10 minutes with TK HOMOMIXER at a revolution of 12,000 rpm, followed by filtering. This operation was repeated twice. Thus, a wet cake (1) was prepared.

The wet cake (1) was dried for 48 hours at 45° C. using a circulating air drier, followed by sieving with a screen having openings of 75 μm.

Thus, toner particles 1 were prepared.

Example 2

The procedure for preparation of the toner particles in Example 1 was repeated except that the emulsification, aging, and solvent removing processes were changed as follows.

Emulsification, Aging and Solvent Removal

The emulsion 1 was fed into a container equipped with a stirrer having paddles and a thermometer, and the emulsion was aged for 30 minutes at 32° C. while agitated at a revolution of 200 rpm. Then the emulsion was heated for 8 hours at 30° C. to remove the organic solvent (ethylacetate) from the emulsion. Thus, a dispersion 2 was prepared. The particles dispersed in the dispersion 2 have a volume average particle diameter of 5.56 μm and a number average particle diameter of 5.19 μm, which was measured with MULTISIZER II.

Washing and Drying

The thus prepared dispersion 2 was washed and dried in the same manner as that in Example 1.

Thus, toner particles 2 were prepared.

Example 3

The procedure for preparation of the toner in Example 1 was repeated except that the emulsification, aging, and solvent removing processes were changed as follows.

Emulsification, Aging and Solvent Removal

The emulsion 1 was fed into a container equipped with a stirrer having paddles and a thermometer, and the emulsion was aged for 4 hours at 25° C. while agitated at a revolution of 180 rpm. Then the emulsion was heated for 8 hours at 30 C. to remove the organic solvent (ethyl acetate) from the emulsion. Thus, a dispersion 3 was prepared. The particles dispersed in the dispersion 3 have a volume average particle diameter of 6.22 μm and a number average particle diameter of 5.90 μm, which was measured with MULTISIZER II.

Washing and Drying

The thus prepared dispersion 3 was washed and dried in the same manner as that in Example 1.

Thus, toner particles 3 were prepared.

Example 4

The procedure for preparation of the toner in Example 1 was repeated except that the emulsification, aging, and solvent removing processes were changed as follows.

Emulsification, Aging and Solvent Removal

The emulsion 1 was fed into a container equipped with a stirrer having paddles and a thermometer, and the emulsion was aged for 2 hours at 27° C. while agitated at a revolution of 180 rpm. Then the emulsion was heated for 8 hours at 30° C. to remove the organic solvent (ethyl acetate) from the emulsion. Thus, a dispersion 4 was prepared. The particles dispersed in the dispersion 4 have a volume average particle diameter of 6.48 μm and a number average particle diameter of 5.77 μm, which was measured with MULTISIZER II.

Washing and Drying

The thus prepared dispersion 4 was washed and dried in the same manner as that in Example 1.

Thus, toner particles 4 were prepared.

Example 5

The procedure for preparation of the toner in Example 1 was repeated except that the emulsion 1 was replaced with an emulsion 2, which was prepared by the following method, to prepare toner particles 5.

At first, 753 parts of the colbrant/wax dispersion 1, 154 parts of the prepolymer 1 and 3.8 parts of the ketimine compound 1 were fed in a container, and the mixture was subjected to a dispersion treatment for 1 minute using TK HOMOMIXER at a revolution of 5000 rpm. Then 1200 parts of the aqueous phase liquid 1 were added thereto, and the mixture was agitated for 20 minutes using TK HOMOMIXER at a revolution of 13000 rpm. Thus, an emulsion 2 was prepared.

Example 6

Synthesis of Unmodified Polyester Resin 2

The following components were contained in a reaction container equipped with a condenser, a stirrer and a nitrogen feed pipe to perform a polycondensation reaction for 8 hours at 230° C. under normal pressure.

| | |
|---|---|
| Propylene oxide (2 mole) adduct of bisphenol A | 196 parts |
| Ethylene oxide (2 mole) adduct of bisphenol A | 553 parts |
| Terephthalic acid | 210 parts |
| Adipic acid | 79 parts |
| Dibutyltin oxide | 2 parts |

Then the reaction was further continued for 5 hours under a reduced pressure of from 10 to 15 mmHg.

Further, 26 parts of trimellitic anhydride were fed to the container to be reacted with the reaction product for 2 hours at 180° C. under a normal pressure. Thus, an unmodified polyester resin 2 was prepared. The unmodified polyester resin 2 has a number average molecular weight of 2400, a weight average molecular weight of 6200, a glass transition temperature (Tg) of 43° C. and an acid value of 15 mgKOH/g.

The procedure for preparation of the emulsion 1 in Example 1 was repeated except that the unmodified polyester resin 1 was replaced with an unmodified polyester resin 2, to prepare an emulsion 3.

The procedure for preparation of the toner in Example 1 was repeated except that the emulsion 1 was replaced with an emulsion 3 to prepare toner particles 6.

Example 7

The procedure for preparation of the toner in Example 1 was repeated except that the emulsification, aging, and solvent removing processes were changed as follows.

Emulsification, Aging and Solvent Removal

The emulsion 3, which was prepared in Example 6, was fed into a container equipped with a stirrer having paddles and a thermometer, and the emulsion was aged for 1 hour at 28° C. while agitated at a revolution of 230 rpm. Then the emulsion was heated for 8 hours at 30° C. to remove the organic solvent (ethyl acetate) from the emulsion. Thus, a dispersion 5 was prepared. The particles dispersed in the dispersion 5 have a volume average particle diameter of 6.67 μm and a number average particle diameter of 5.47 μm, which was measured with MULTISIZER II.

Washing and Drying

The thus prepared dispersion 5 was washed and dried in the same manner as that in Example 1.

Thus, toner particles 7 were prepared.

Comparative Example 1

In a container, 709 g of ion-exchange water, and 451 g of a 0.1 mole aqueous solution of sodium phosphate were mixed and agitated with TK HOMOMIXER at a revolution of 12000 rpm. Then 68 g of a 1.0 mole aqueous solution of calcium chloride were gradually added thereto. Thus, an aqueous medium including calcium phosphate was prepared.

On the other hand, 170 g of styrene, 30 g of 2-ethylhexyl acrylate, 10 g of a carbon black (REGAL 400R from Cabot Corp.), 60 g of a paraffin wax having a softening point of 70° C., 5 g of a di-tert-butyl salicylic acid metal compound, and a styrene/methacrylic acid copolymer having a weight average molecular weight of 50,000 and an acid value of 20 mgKOH/g, were mixed with TK HOMOMIXER at a revolution of 12000 rpm while heated to 60° C. Then 10 g of a polymerization initiator, 2,2'-azobis(2,4-dimethylvaleronitrile were added thereto.

The thus prepared monomer liquid was added to the aqueous medium prepared above and the mixture was agitated for 20 minutes at 60° C. using TK HOMOMIXER at a revolution of 10000 rpm under a nitrogen gas flow. Thus, an emulsion including particles of the monomers was prepared. Then the emulsion was subjected to a reaction at 60° C. for 3 hours while agitated with a stirrer having paddles. Then the liquid was further reacted for 10 hours at 80° C. After the reaction, the liquid was cooled and hydrochloric acid was added thereto to dissolve the calcium phosphate included therein. Then the mixture was filtered, and the resultant cake was washed with water and dried. Thus, toner particles 8 were prepared.

Comparative Example 2

Preparation of Wax Dispersion 1

In a 1000 ml four necked flask equipped with a stirrer, a thermosensor, a nitrogen feed pipe and a condenser, 500 ml of distilled water which had been deaerated, 28.5 g of a surfactant NEWCOL 565C from Nippon Nyukazai Co., Ltd., 185.5 g of a candelilla wax No. 1 from CERARICA NODA Co., Ltd., were mixed with the stirrer under nitrogen gas flow. The mixture was heated to 85° C. and a 5N aqueous solution of sodium hydroxide was added thereto. The mixture was agitated for 1 hour with the stirrer while the temperature of the mixture was controlled so as to be 75° C. Then the mixture was cooled to room temperature. Thus, a wax dispersion 1 was prepared.

Preparation of Colorant Dispersion 1

In a container, 100 g of a carbon black (MOGUL L from Cabot Corp.), 25 g of sodium dodecylsulfate and 540 ml of distilled water were mixed and agitated. Then the mixture was dispersed with a pressure dispersing machine (MINI-LAB from Raney Corp.). Thus, a colorant dispersion 1 was prepared.

Preparation of Binder Resin Dispersion 1

In a 1000 ml four necked flask equipped with a stirrer, a thermosensor, a nitrogen feed pipe and a condenser, 480 ml of distilled water, 0.6 g of sodium dodecylsulfate, 106.4 g of styrene, 43.2 g of n-butyl acrylate and 10.4 g of methacrylic acid were mixed, and the mixture was heated to 70° C. under a nitrogen gas flow while agitated. Then an initiator solution which had been prepared by dissolving 2.1 g of potassium persulfate in 120 ml of distilled water was added thereto. The mixture was agitated for 3 hours at 70° C. under a nitrogen gas flow. After the polymerization reaction was completed, the reaction product was cooled to room temperature. Thus, a binder resin dispersion 1 was prepared.

Preparation of Binder Resin Dispersion 2

In a 1000 ml four necked flask equipped with a stirrer, a thermosensor, a nitrogen feed pipe and a condenser, 2400 ml of distilled water, 2.8 g of sodium dodecylsulfate, 620 g of styrene, 128 g of n-butyl acrylate and 27.4 g of tert-dodecyl mercaptan were mixed and the mixture was heated to 70° C. under a nitrogen gas flow while agitated. Then an initiator solution which had been prepared by dissolving 11.2 g of potassium persulfate in 600 ml of distilled water was added thereto. The mixture was agitated for 3 hours at 70° C. under a nitrogen gas flow. After the polymerization reaction was completed, the reaction product was cooled to room temperature. Thus, a binder resin dispersion 2 was prepared.

Preparation of Toner

In a 1000 ml separable flask equipped with a stirrer, a condenser and a thermosensor, 47.6 g of the binder resin dispersion 1, 190.5 g of the binder resin dispersion 2, 7.7 g of the wax dispersion 1, 26.7 g of the colorant dispersion and 252.5 ml of distilled water were mixed. Then a 5N aqueous solution of sodium hydroxide was added to the mixture to control the pH of the mixture to be 9.5. In addition, a sodium chloride solution which had been prepared by dissolving 50 g of sodium chloride in 600 ml of distilled water, and a surfactant solution which had been prepared by dissolving 77 ml of isopropanol and 10 mg of a fluorine-containing nonionic surfactant (FLUORAD FC-170C from Sumitomo 3M Ltd.) in 10 ml of distilled water, were added thereto one by one. Then the temperature of the mixture was raised to 85 and the mixture was reacted for 6 hours. Then the reaction product was cooled to room temperature. Then a 5N aqueous solution of sodium hydroxide was added to the mixture to control the pH of the mixture to be 13. Then the mixture was filtered and the cake was dispersed again in distilled water, followed by filtering. This operation was repeated twice. Then the cake was dried to prepare toner particles 9.

Comparative Example 3

Preparation of Toner by Kneading/Pulverizing Method Synthesis of Linear Polyester Resin The following components were contained in a reaction container equipped with a condenser, a stirrer and a nitrogen feed pipe to perform a polycondensation reaction for 10 hours at 225° C. under a nitrogen gas flow while generated water was removed.

| | |
|---|---|
| Ethylene oxide (2 mole) adduct of bisphenol A | 320 parts |
| Propylene oxide (2 mole) adduct of_ bisphenol A | 480 parts |
| Terephthalic acid | 200 parts |
| Phthalic acid | 65 parts |
| Titanylpotassium oxalate (polycondensation catalyst) | 2 parts |

Then the reaction was further continued under a reduced pressure of from 5 to 20 mmHg. After the reaction was completed, the reaction product was cooled to room temperature. Thus, a linear polyester resin M-1 was prepared. The polyester resin M-1 includes no THF (tetrahydrofuran)-soluble component, and has an acid value of 14 mgKOH/g, a hydroxyl value of 40 mgKOH/g, a glass transition temperature (Tg) of 59° C., a number average molecular weight of 5100, a weight average molecular weight of 22000 and a maximum peak molecular weight of 4400.

Preparation of Masterbatch 2

The following components were kneaded at 70° C. using a two roll mill.

| | |
|---|---|
| Linear polyester resin M-1 prepared above | 100 parts |
| Carbon black | 100 parts |
| Pure water | 50 parts |

Then the kneaded mixture was performed at 120° C. to remove the water from the kneaded mixture. Thus, a masterbatch 2 was prepared.

Synthesis of Non-Linear Polyester Resin

The following components were contained in a reaction container equipped with a condenser, a stirrer and a nitrogen feed pipe to perform a polycondensation reaction for 10 hours at 230° C. under a nitrogen gas flow while generated water was removed.

| | |
|---|---|
| Ethylene oxide (2 mole) adduct of bisphenol A | 400 parts |
| Propylene oxide (3 mole) adduct of bisphenol A | 269 parts |
| Trimellitic acid | 50 parts |
| Terephthalic acid | 278 parts |
| Phthalic anhydride | 40 parts |
| Titanylpotassium oxalate (polycondensation catalyst) | 2 parts |

Then the reaction was further continued under a reduced pressure of from 5 to 20 mmHg. When the reaction product had an acid value not greater than 10 mgKOH/g, the reaction product was cooled to 180° C. Then, 6 parts of trimellitic anhydride were added thereto, and the mixture was reacted in a closed vessel for 2 hours under a normal pressure. Then the reaction product was cooled to room temperature, followed by pulverization. Thus, a non-linear polyester resin H-1 was prepared. The thus prepared polyester resin H-1 includes THF (tetrahydrofuran)-soluble components in an amount of 5% by weight, and has an acid value of 13 mgKOH/g, a hydroxyl value of 67 mgKOH/g, a glass transition temperature (Tg) of 70° C., a number average molecular weight of 9600, a weight average molecular weight of 45000 and a maximum peak molecular weight of 11000.

Preparation of Toner

The following components were mixed using a HENSCHEL mixer (FM10B from Mitsui Miike Machinery Co., Ltd.).

| | |
|---|---|
| Polyester resin M-1 prepared above | 10 parts |
| Polyester resin H-1 prepared above | 90 parts |
| Masterbatch 2 prepared above | 20 parts |
| Ester wax (acid value of 5 mgKOH/g, weight average molecular weight (Mw) of 1600, average particle diameter of 120 μm) | 3 parts |

Then the mixture was kneaded at 120° C. using a double-axis kneader (PCM-30 from Ikegai Corp.). After the kneaded mixture was cooled, the mixture was pulverized using a supersonic jet air pulverizer LABJET from Nippon Pneumatic Mfg. Co., Ltd., followed by classification using an air classifier (MDS-I from Nippon Pneumatic Mfg. Co., Ltd.). Thus, toner particle 10 having a volume average particle diameter of 6.8 μm were prepared.

Then 100 parts of each of the thus prepared toner particles 1-10 were mixed with an external additive consisting of 1.0 part of a hydrophobized silica and 0.3 parts of hydrophobized titanium oxide were mixed using a HENSCHEL mixer. The physical properties of the thus prepared toners 1-10 are shown in Table 1

Preparation of Developer

The following components were mixed to prepare developers.

| | |
|---|---|
| Copper - zinc ferrite carrier coated with a silicone resin (average particle diameter of 40 μm) | 95 parts |
| Each of toners 1-10 | 5 parts |

Evaluation of the Toners and Developers (A) Average Particle Diameter

The volume average particle diameter (Dv) and number average particle diameter (Dn) of each toner were measured using an instrument COULTER COUNTER TAII from Coulter Electronics Inc. and an aperture of 100 μm. In addition, the ratio Dv/Dn was determined on calculation.

(B) Average Circularity (AC)

The average circularity of the toner can be determined as an average spherical degree by a flow-type particle image analyzer, FPIA-1000 manufactured by Sysmex Corp.

Specifically, the method are as follows:

(1) 0.1 g to 0.5 g of a sample to be measured is mixed with 100 to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per 1 micro-liter of the suspension; and (3) the average circularity of the sample in the suspension is determined by the measuring instrument mentioned above.

(C) Storage Modulus (G') at 180° C.

The storage modulus (G') of each toner is measured at 180° C. under a condition of 1 Hz in frequency.

(D) Fixing Properties

Figure 3:
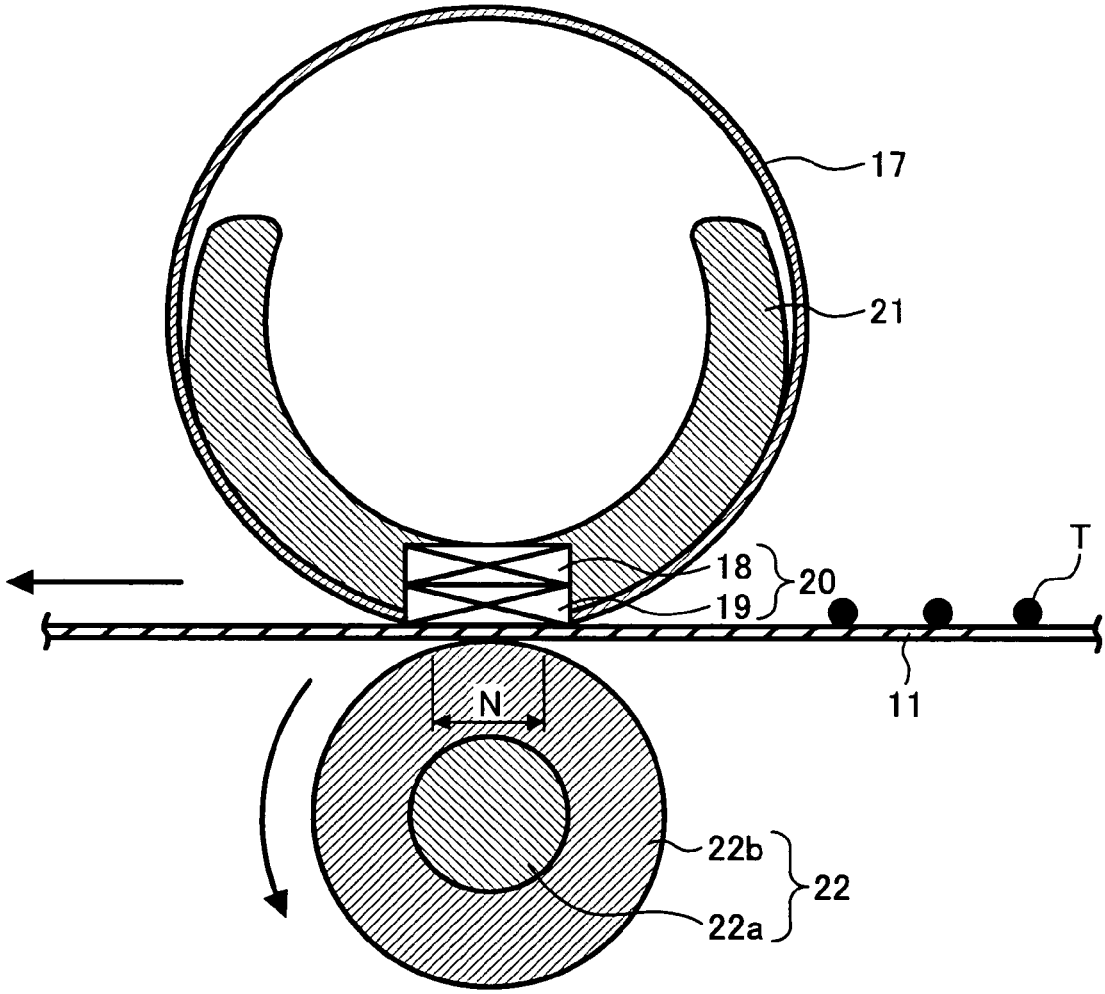
FIG. 3 is a schematic view illustrating a conventional fixing device using electromagnetic induction heating.

Each developer was set in a color copier IPSIO COLOR 8100 from Ricoh Co., Ltd. which is modified so as to have a fixing device (A) illustrated in FIG. 1 (which was used for all the toners 1-10) or a fixing device (B) illustrated in FIG. 3 (which is used for only the toner 1 to compare the images produced by the fixing devices (A) and (B)), and solid toner images having a weight of 1.0±0.05 mg/cm$^2$ were formed on sheets of a paper TYPE 6200 from Ricoh Co., Ltd., and sheets of a copy and print paper <135> while changing the temperature of the fixing belt (i.e., the heat roller).

Hot Offset Temperature (HOT)

The glossiness of fixed toner images formed on the paper TYPE 6200 were measured to determine whether a hot offset problem is caused.

The hot offset temperature is defined as a fixing temperature above which the glossiness of the fixed toner images decreases.

Minimum Fixable Temperature (MFT)

At first, each solid image formed on the paper <135> was scratched with a drawing needle. Then the solid image was observed to determine whether the toner layer of the scratched portion is peeled to an extent such that the surface of the paper is observed. The minimum fixable temperature is defied as a minimum fixing temperature above which the toner layer of the scratched portion is not peeled and thereby the surface of the paper is not observed. It is preferable that the minimum fixable temperature is not higher than 150° C.

Smear Property (SM)

At first, the image density (ID1) of each solid image was measured with a densitometer. Then the solid image was rubbed with a pad, and the image density (ID2) of the rubbed solid image was measured with the densitometer to determine the fixing rate (i.e., (ID2/ID1)×100). The smear property of the toner is evaluated using the fixable temperature above which the fixing rate is not less than 80%. Namely, the lower fixable temperature a toner has, the better smear property the toner has.

(D) Durability

Each of the toners 1-10 was set in the copier IPSIO COLOR 8100 having a fixing device illustrated in FIG. 1 to perform a running test in which 30000 sheets of paper TYPE 6200 having a toner image with a fixing rate of 50% are produced. After the running test, the surface of the fixing belt was observed to determine whether the surface is damaged with toner particles and the surface of the toner images on the paper were also observed to determine whether the toner images have an abnormal image.

The durability of the fixing belt is classified into the following three grades.

○: The surface of the fixing belt is not damaged, and the toner images have no abnormal images. (good)

Δ: The surface of the fixing belt is slightly damaged, but the toner images have no abnormal images. (acceptable)

X: The surface of the fixing belt is damaged, and the toner images have small abnormal images. (not acceptable)

The results are shown in Table 1.

TABLE 1

| | Fixer | Particle diameter Dv (μm) | Dn (μm) | Dv/Dn | AC | G' | Fixing property MFT (° C.) | HOT (° C.) | SM (° C.) | Durability |
|---|---|---|---|---|---|---|---|---|---|---|
| Ex. 1 | A | 6.15 | 5.77 | 1.07 | 0.95 | 2190 | 130 | ≧220 | 125 | ○ |
| Ex. 2 | A | 6.05 | 5.78 | 1.05 | 0.94 | 1050 | 130 | 220 | 125 | ○ |
| Ex. 3 | A | 6.24 | 5.72 | 1.09 | 0.92 | 2450 | 140 | ≧220 | 125 | ○ |
| Ex. 4 | A | 6.30 | 6.00 | 1.05 | 0.96 | 4300 | 145 | ≧220 | 125 | ○ |
| Ex. 5 | A | 5.50 | 4.87 | 1.13 | 0.93 | 3590 | 140 | ≧220 | 125 | ○ |
| Ex. 6 | A | 5.05 | 4.51 | 1.12 | 0.94 | 3810 | 140 | ≧220 | 125 | ○ |
| Ex. 7 | A | 6.69 | 5.52 | 1.21 | 0.95 | 5500 | 150 | 210 | 125 | ○ |
| Comp. Ex. 1 | A | 6.30 | 5.62 | 1.12 | 0.98 | 4410 | 175 | 210 | 180 | Δ |
| Comp. Ex. 2 | A | 6.22 | 5.16 | 1.21 | 0.96 | 3550 | 155 | 205 | 165 | Δ |
| Comp. Ex. 3 | A | 6.82 | 5.31 | 1.28 | 0.90 | 2300 | 130 | ≧220 | 165 | Δ |
| Comp. Ex. 4 | B | 6.15 | 5.77 | 1.07 | 0.95 | 2190 | 130 | ≧220 | 180 | X |

As can be understood from Table 1, the toners of Examples 1 to 7 have good combination of fixing properties and durability.

Effects of the Present Invention

By using a combination of a toner prepared by a specific method and a fixing device utilizing electromagnetic induction heating, high quality toner images can be produced for a long period of time without causing a hot offset problem and a smear problem while energy is saved.

This document claims priority and contains subject matter related to Japanese Patent Application No. 2003-361851, filed on Oct. 22, 2003, incorporated herein by reference.

Having now fully described the invention, it will be apparent to one of ordinary skill in the art that many changes and modifications can be made thereto without departing from the spirit and scope of the invention as set forth therein.

What is claimed as new desired to be secured by Letters Patent of the United States is:

1. An image forming method comprising:

forming a toner image on a support using a toner including toner particles which are prepared by a method including:

dissolving or dispersing toner constituents comprising a binder resin containing at least a modified polyester resin reactive with an active hydrogen atom in an organic solvent to prepare a toner constituent liquid;

dispersing the toner constituent liquid in an aqueous medium comprising a particulate resin to prepare an emulsion;

reacting the modified polyester resin with a compound having an active hydrogen atom in the emulsion to subject the modified polyester resin to at least one of a crosslinking reaction and an extension reaction; and removing the organic solvent from the emulsion, and feeding the support bearing the toner image thereon through a nip between an endless toner heating member and a pressure roller to fix the toner image on the support, wherein the endless toner heating member is rotated while stretched by a fixing roller and a heat roller which comprises a magnetic metal and which is heated by electromagnetic induction, and wherein the pressure roller presses the support bearing the toner image to the endless toner heating member and the fixing roller at the nip, wherein the toner has a storage modulus G' of from 700 Pa to 4300 Pa at 180° C. under a condition of 1 Hz in frequency, and wherein the toner has an average circularity of from 0.90 to 0.96.

2. The image forming method according to claim 1, wherein the endless toner heating member has a thickness of from 50 to 500 μm.

3. The image forming method according to claim 1, wherein the binder resin further comprises an unmodified polyester resin in an amount such that a ratio (i)/(ii) of the modified polyester resin (i) to the unmodified polyester resin (ii) is from 5/95 to 75/25.

4. The image forming method according to claim 1, wherein the binder resin has an acid value of from 0.5 to 40 mgKOH/g.

5. The image forming method according to claim 1, wherein the binder resin has a glass transition temperature (Tg) of from 40 to 70° C.

6. The image forming method according to claim 5, wherein the binder resin has a glass transition temperature (Tg) of from 40 to 55° C.

7. The image forming method according to claim 1, wherein the particulate resin is selected from the group consisting of vinyl resins, polyurethane resins, polyester resins, and mixtures thereof.

8. The image forming method according to claim 1, wherein the particulate resin preferably has an average particle diameter of from 5 to 500 nm.

9. The image forming method according to claim 1, wherein the toner has a volume average particle diameter (Dv) of from 4 to 8 μm.

10. The image forming method according to claim 1, wherein the toner has a ratio (Dv/Dn) of a volume average particle diameter (Dv) to a number average particle diameter (Dn) not greater than 1.25.

11. The image forming method according to claim 1, wherein aging is performed while the emulsion is subjected to at least one of agitation and heating.

12. The image forming method according to claim 1, wherein the heat roller is heated at a point other than at the fixing nip.

13. The image forming method according to claim 1, wherein the wherein the toner has a storage modulus G' of from 1050 Pa to 3810 Pa at 180° C. under a condition of 1 Hz in frequency, and wherein the toner has an average circularity of from 0.92 to 0.95.

* * * * *